United States Patent [19]

Déneux et al.

[11] 4,430,855

[45] Feb. 14, 1984

[54] PROCESS FOR DETECTION OF ROTATING STALL

[75] Inventors: Pierre E. Déneux, Vaux le Penil; Patrick J. Faure, Courances; Denis R. G. Laffitte, Miramas; Michel E. M. Lemaoult, Livry sur Seine, all of France

[73] Assignee: SNECMA, Paris, France

[21] Appl. No.: 292,577

[22] Filed: Aug. 13, 1981

[30] Foreign Application Priority Data

Aug. 13, 1980 [FR] France ..... 80 18024

[51] Int. Cl.[3] ..... F02C 9/28

[52] U.S. Cl. ..... 60/39.03; 60/39.161; 60/39.27; 60/39.281; 60/39.29

[58] Field of Search ..... 60/39.161, 39.27, 39.281, 60/39.29, 236, 239, 39.03, 39.24; 415/27, 28; 340/27 SS; 364/494

[56] References Cited

U.S. PATENT DOCUMENTS

| | | | |
|---|---|---|---|
| 2,785,848 | 3/1957 | Lombard et al. . | |
| 2,918,790 | 12/1959 | Schoch . | |
| 3,638,422 | 2/1972 | Loft . | |
| 3,854,287 | 12/1974 | Rembold | 60/236 |
| 3,971,208 | 7/1976 | Schwent | 60/39.27 X |
| 4,060,979 | 12/1977 | Elsaesser et al. | 60/39.27 X |
| 4,060,980 | 12/1977 | Elsaesser et al. | 60/39.27 X |
| 4,117,668 | 10/1978 | Elsaesser et al. | 60/39.281 X |

FOREIGN PATENT DOCUMENTS

| | | |
|---|---|---|
| 2332427 | 11/1976 | France . |
| 1422572 | 1/1976 | United Kingdom . |
| 1492924 | 11/1977 | United Kingdom . |

*Primary Examiner*—Louis J. Casaregola
*Assistant Examiner*—Donald E. Stout
*Attorney, Agent, or Firm*—Oblon, Fisher, Spivak, McClelland & Maier

[57] ABSTRACT

A process and a device for detecting a rotating stall in a turbojet engine having two rotating spools including a high pressure spool and a low pressure spool, wherein the rotation speed ($N_{HP}$, $N_{BP}$) of each of said spools is measured, and the derivative relative to time $dN_{HP}/dt$ of the rotation speed ($N_{HP}$) of the high pressure spool is derived. A command signal is generated as soon as the following conditions are met:

$$N_{HP} - (A \cdot N_{BP}) > B, \text{ and } \frac{dN_{HP}}{dt} > C$$

where A, B and C are constant values.

5 Claims, 2 Drawing Figures

PROCESS FOR DETECTION OF ROTATING STALL

BACKGROUND OF THE INVENTION

1. Field of the Invention

This invention relates to a process for detecting rotating stall in a turbojet engine having two revolving spools including a high pressure spool and a low pressure spool, wherein the rotation speed of each of the spools is measured. The invention also relates to a device for the detection of rotating stall.

2. Description of the Prior Art

The gas turbine engine shown in FIG. 1 is one illustration of the various types of motors for which the present invention may be employed.

The gas turbine engine illustrated in FIG. 1 is an axial flow by-pass turbine engine including a motor housing (1) in which are mounted, in conventional rotary fashion, a low pressure compressor (2) and its driving turbine (3), as well as a high pressure compressor (4) and its driving turbine (5). A combustion device (6) burns the fuel which it receives from a command (not shown), by releasing gases that propel the turbines (3, 5), while these gases are later expelled through a nozzle so as to produce thrust.

Rotating stall is a phenomenon which affects all turbojet engines under various operating conditions. Although its causes are not well-known, the effects on two-spool engines are almost always the following:

- a rapid drop in the exhaust pressure of the compressor (2, 4), followed by an increase in this pressure which is less than the normal rate of increase;
- a sudden increase of the temperature (T) of the gas flow at the inlet of the turbines (5, 3), which sometimes manifests itself as a break in the slope of the curve of this temperature as a function of time, and a stabilization of this temperature at levels higher than the normal recommended level;
- an increase in the rate of rotation ($N_{HP}$) of the high pressure spool (**4*a*, 5**) which is less than the normal rate of increase;
- an instantaneous stabilization of the rate of rotation ($N_{BP}$) of the low pressure spool (**2*a*, 3**), followed by a slight increase in this $N_{BP}$ rate;
- sometimes, there are rumbling sounds and an operation reversal called "surge" of the compressor (2, 4).

At the end of a time interval of several seconds, these parameters (T, $N_{NP}$, $N_{BP}$) stabilize at values that are different from those corresponding to normal stabilization, but, under certain conditions, serious accidents can occur suddenly, such as extinction of the combustion device (6), breakage of blades, etc.

It is therefore important for the pilot or other user to be quickly warned of the appearance of rotating stall or of the imminence of its occurrence so as to be able to take the necessary preventive measures in time.

SUMMARY OF THE INVENTION

Accordingly one object of this invention is to provide a novel process for investigating a turbine engine's operating parameters, which develop prior to the appearance of rotating stall in a characteristic manner.

A further object of the invention consists of defining a parametric relationship characteristic of the appearance of rotating stall.

Yet another object of the invention consists of developing a device which is capable of utilizing the data originating from appropriate gauges, processing them in a functions generator, discriminating when two conditions are joined, and setting off an alarm at the pilot controls of the turbojet engine.

For these reasons, the process according to the invention, according to which the rotation speed $N_{HP}$, $N_{BP}$ of each of the revolving spools is measured, is characterized by the fact that the derivative relative to time $dN^{dN}HP/dt$ is subtracted from the rotation speed $N_{HP}$ of the high pressure spool and a command signal is generated as soon as the following relationships are met:

$$N_{HP} - (A \cdot N_{BP}) > B, \text{ and } \frac{dN_{HP}}{dt} > C$$

where A, B and C are constant values.

Thus, in a specific application of the invention to a conventional engine, the following values are determined, when the rotation speeds are expressed as percentages of the nominal value:

A varies between 1 and 1.5, B varies between 8 and 30, C varies between −0.6 and −0.2; and in a specific case, A is equal to 1.26; B is equal to 18.2 and C is equal to −0.4.

When the rotation speeds are expressed as absolute values, A is taken to be equal to 1.62; B equals 4106 rpm, and C equals −250 rpm/s.

For example, the command signal serves to set off an alarm.

Alternatively or simultaneously, according to one aspect of the invention, the command signal serves to set off a maneuver enabling a return to normal operating conditions of the engine.

The detection device according to the invention is of the type including a first detector which measures the rotation speed ($N_{HP}$) of the high pressure spool and a second detector which measures the rotation speed ($N_{BP}$) of the low pressure spool; a multiplier by a constant (A), which multiplier receives the signal ($^{N}BP$) emitted by the second detector; a subtracter which subtracts from the signal ($N_{HP}$) emitted by the first detector the signal ($A.N_{BP}$) provided by the multiplier; a first comparator which compares the signal ($N_{HP}-(A \cdot N_{BP})$) provided by the subtracter with a reference signal (B) provided by a reference signal source; a differentiator which receives the signal ($N_{HP}$) emitted by the first detector; a second comparator which compares the signal $dN_{HP}/dt$ provided by the differentiator with a second reference signal (C) provided by a second reference signal source, the first and second comparators each being of the type which provides a logical "0" or "1" signal according to whether the reference signal received thereby is higher than or lower than the other signal applied thereto; and an AND gate having two inputs, each receiving the output signal of a respective comparator, and an output which issues a command signal.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Thus, according to the invention, the parameters employed are the revolution speeds of the high pressure and low pressure spools. The parametric relationship is as follows:

$$N_{HP}-(A \cdot N_{BP})>B$$

A discrimination factor in the form of a test on the derivative of the rotation rate of the high pressure spool relative to time eliminates the normal deceleration phases of the motor:

$$\frac{dN_{HP}}{dt} > C$$

In the case of a two-spool engine of a given type, by drawing the curves for operating under the various conditions of use of the engine, which curves represent the corresponding variations of the rotation speeds $N_{HP}$ of the high pressure spool and $N_{BP}$ of the low pressure spool (coordinates $N_{HP}$ and $N_{BP}$), there is directly obtained a straight line which is tangent to the curves drawn and which is an envelope of these curves. The constants A and B represent the coefficients that give the equation of this straight line:

$$N_{HP}-A \cdot N_{BP}=B.$$

Likewise, for an engine of a given type the plotting of the normal operating conditions and, in particular, the verification of the normal deceleration conditions make it possible to determine a limiting value of the constant C so that the normal decelerations of the engine meet the condition relating to the rotation speed of the high pressure spool:

$$\frac{dN_{HP}}{dt} < C.$$

These normal phases are therefore eliminated by the discriminating criterion defined above:

$$\frac{dN_{HP}}{dt} > C$$

A specific application of this process provides the following values, the values of $N_{HP}$ and $N_{BP}$ being expressed as percentages of the nominal rates of the high pressure and low pressure spools, and the time (dt) expressed in seconds:

$$A=1.26;\ B=18.2;\ C=-0.4.$$

When $N_{HP}$ and $N_{BP}$ are expressed in rpm and the time (dt) is expressed in seconds, take:

$$A=1.62;\ B=4106\ \text{rpm};\ C=-250\ \text{rpm/s}.$$

This detection process provides many advantages:

- the $N_{HP}$ and $N_{BP}$ parameters are obtained with very high precision and have low dispersion;
- ISA (International Standard Atmosphere) conditions have very little influence on these parameters;
- the maximal detection time is on the order of three seconds;
- these parameters, necessary to detection, are already employed for normal regulation.

Figure 1:
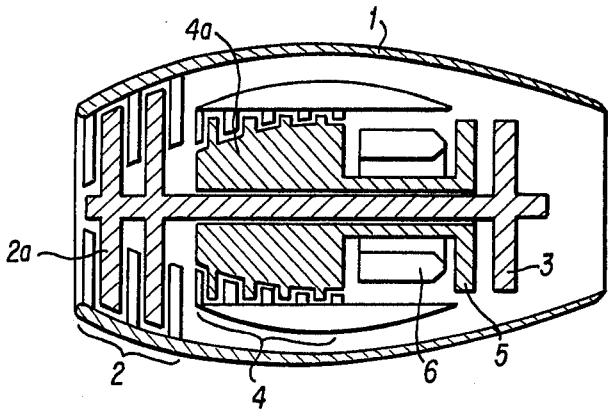
FIG. 1 is an axial cross-sectional view through an axial flow by-pass gas turbine engine.
Figure 2:
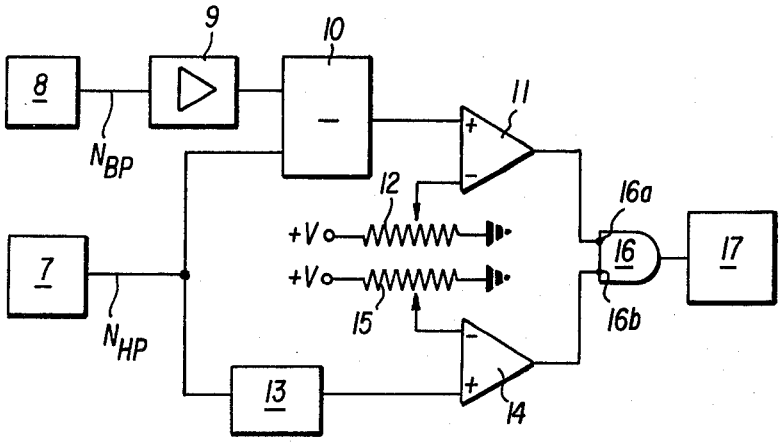
FIG. 2 is a block diagram of a detection device according to one embodiment of the invention.

Referring now to FIG. 2, the device for detection of rotating stall shown includes: a first detector (7) which measures the rotation speed ($N_{HP}$) of the high pressure spool (4a, 5) and a second detector (8) which measures the rotation speed ($N_{BP}$) of the low pressure spool (2a, 3); a multiplier 9 which receives the signal ($N_{BP}$) emitted by the second detector (8) and multiplies the signal ($N_{BP}$) by a constant A; a subtracter (10) which subtracts from the signal ($N_{HP}$) emitted by the first detector (7), the product signal ($A.N_{BP}$) provided by the multiplier (9), a first comparator (11) which compares the signal ($N_{HP}-(A \cdot N_{BP})$ provided by the subtractor (10) with a reference signal (B) provided by a reference signal source (12); a differentiator (13) which receives the signal ($N_{HP}$) emitted by the first detector (7); a second comparator (14) which compares the signal $^{dN}HP/dt$ provided by the differentiator (13) with a second reference signal (C) provided by a second reference signal source (15), the first and second comparators (11, 14) each being of the type which provides a logical "0" or "1" signal, according to whether the reference signal received by the respective comparator is, respectively, lower or higher than the other signal applied thereto; and an AND gate (16), having two inputs (16a, 16b) each receiving the output signal of a respective comparator (11, 14).

Based on the HP and BP rate detectors, 7 and 8, the various function generators (9, 10 and 13) compute the values of $N_{HP}-(A \cdot N_{BP})$ and $^{dN}HP/dt$.

When the two conditions of:

$$N_{HP}-(A \cdot N_{BP}) > B$$

$$\frac{dN_{HP}}{dt} > C$$

are met, the logical circuit 11, 12, 14, 15, 16 sets off a visual or sound (or both) alarm which warns the pilot that the engine is in rotating stall. He can then follow a procedure which will restore the engine's normal operating conditions.

The detection device (7 to 16) could be made to perform automatically a procedure which will enable a return to normal operating conditions (for instance, programming a negative flow step) and a gradual return to the original operating point.

The device shown in FIG. 2 may employ conventional electronic components; however, other elements, for example fluids, may be used. It may be advantageous to employ, for the detection of $N_{HP}$ and $N_{BP}$, detectors which already exist in the regulator; alternatively, these detectors may also be specific to the device.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A process for detecting rotating stall in a turbojet engine having at least two revolving spools including a high pressure spool and a low pressure spool, comprising:

measuring the rotational speeds ($N_{HP}$,$N_{BP}$) of each of the two spools;

obtaining the derivative relative to time $^{dN}$HP/dt the rotation speed ($N_{HP}$) of the high pressure spool;

multiplying the rotation speed ($N_{BP}$) of the low pressure spool by a first constant value A;

subtracting from the rotation speed ($N_{HP}$) of the high pressure spool the product ($A \cdot N_{BP}$);

comparing the subtraction result ($N_{HP} - A \cdot N_{BP}$) with a second constant value B;

comparing the derivative $^{dN}$HP/dt with a third constant value C; and, generating a command signal serving to trigger a procedure enabling restoration of the engine's normal operating conditions as soon as the following relationships are met, $$N_{HP} - (A \cdot N_{BP}) > B, \text{ and } \frac{dN_{HP}}{dt} > C$$

where constant values A and B are determined for the considered engine by the coefficients of the line which is tangent to all the normal operating curves showing the variations of the rotational speeds ($N_{HP}$, $N_{BP}$) of each of the two spools in the coordinates $N_{HP}$ and $N_{BP}$, this line being of the shape:

$$N_{HP} - A \cdot N_{BP} = B:$$

and where constant value C is determined for the considered engine with regard to the normal deceleration conditions of the engine which meets the following relationship:

$$\frac{dN_{HP}}{dt} < C.$$

2. A process according to claim 1, wherein when the rotation speeds are expressed as percentages of nominal values, the coefficients are in the following ranges:

$1 \leqq A \leqq 1.5$, $8 \leqq B \leqq 30$, and $-0.6 \leqq C \leqq -0.2$.

3. A process as claimed in claim 2, wherein, essentially, A is equal to 1.26; B is equal to 18.2 and C is equal to −0.4.

4. A process as claimed in claim 1, wherein, when the rotation speeds are expressed as absolute values, the coefficients are, essentially, A is equal to 1.62; B is equal to 4106 rpm and C is equal to −250 rpm/s.

5. A process as claimed in claim 1, 2, 3 or 4, wherein said command signal serves to set off an alarm.

* * * * *

UNITED STATES PATENT AND TRADEMARK OFFICE

CERTIFICATE OF CORRECTION

PATENT NO. : 4,430,855

DATED : FEBRUARY 14, 1984

INVENTOR(S) : PIERRE E. DENEUX; PATRICK J. FAURE; DENIS R.G. LAFFITTE; MICHEL E.M. LEMAOULT

It is certified that error appears in the above-identified patent and that said Letters Patent is hereby corrected as shown below:

Column 1, line 51, "$N_{NP}$" should be --$N_{HP}$--.

Column 3, line 47, "$<$" should be -- $\leq$ --.

Column 6, line 10, "$<$" should be -- $\leq$ --.

Signed and Sealed this

*Twenty-sixth* Day of *June 1984*

[SEAL]

*Attest:*

GERALD J. MOSSINGHOFF

*Attesting Officer*

*Commissioner of Patents and Trademarks*